US005088249A

United States Patent [19]

Marzouki

[11] Patent Number: 5,088,249

[45] Date of Patent: Feb. 18, 1992

[54] ROOF COVERING OR WALL COVERING

[75] Inventor: Taieb Marzouki, Langwedel-Etelsen, Fed. Rep. of Germany

[73] Assignee: Roland-Werke Dachbaustoffe und Bauchemie GmbH & Co. KG, Fed. Rep. of Germany

[21] Appl. No.: 340,880

[22] Filed: Apr. 19, 1989

[30] Foreign Application Priority Data

Apr. 21, 1988 [DE] Fed. Rep. of Germany ... 8805266[U]

[51] Int. Cl.[5] ..... E04B 1/94

[52] U.S. Cl. ..... 52/232; 52/168; 52/408

[58] Field of Search ..... 52/406, 168, 232, 1, 52/DIG. 5; 169/57

[56] References Cited

U.S. PATENT DOCUMENTS

| | | | |
|---|---|---|---|
| 2,382,120 | 8/1948 | White | 169/57 |
| 3,104,060 | 9/1963 | Bricmont | 52/168 |
| 3,466,222 | 9/1969 | Curtis | 52/232 |
| 3,786,604 | 1/1974 | Kramer | 52/232 |
| 4,232,742 | 11/1980 | Dick | 52/232 |
| 4,449,336 | 5/1984 | Kelly | 52/232 |
| 4,663,204 | 5/1987 | Langham | 52/232 |
| 4,733,514 | 3/1988 | Kelly | 52/232 |

FOREIGN PATENT DOCUMENTS

| | | | |
|---|---|---|---|
| 244795 | 4/1987 | European Pat. Off. . | |
| 2445489 | 4/1976 | Fed. Rep. of Germany | 52/168 |
| 2518943 | 11/1976 | Fed. Rep. of Germany . | |
| 2914369 | 10/1980 | Fed. Rep. of Germany | 52/168 |
| 2239566 | 2/1975 | France . | |
| 2602257 | 2/1988 | France . | |

OTHER PUBLICATIONS

The Condensed Chemical Dictionary 6th Ed. Reinhold Publishing: New York 1964, p. 1037.

*Primary Examiner*—Richard E. Chilcot, Jr.
*Attorney, Agent, or Firm*—Cook, Egan, McFarron & Manzo, Ltd.

[57] ABSTRACT

A roof covering or wall covering for a building or the like comprising a supporting layer having open channels, preferably made of corrugated metal sheet. Encasing structures, filled with a fire-retarding substance, are located in the channels of the supporting layer. The fire-retarding substance is a thickened liquid. Since the liquid is thickened, it cannot escape or can escape only very slowly from leaky points in the supporting layer in the event of fire. This ensures an evaporation of the fire-retarding liquid to remove the thermoenergy produced during the fire.

9 Claims, 4 Drawing Sheets

ROOF COVERING OR WALL COVERING

Figure 1:
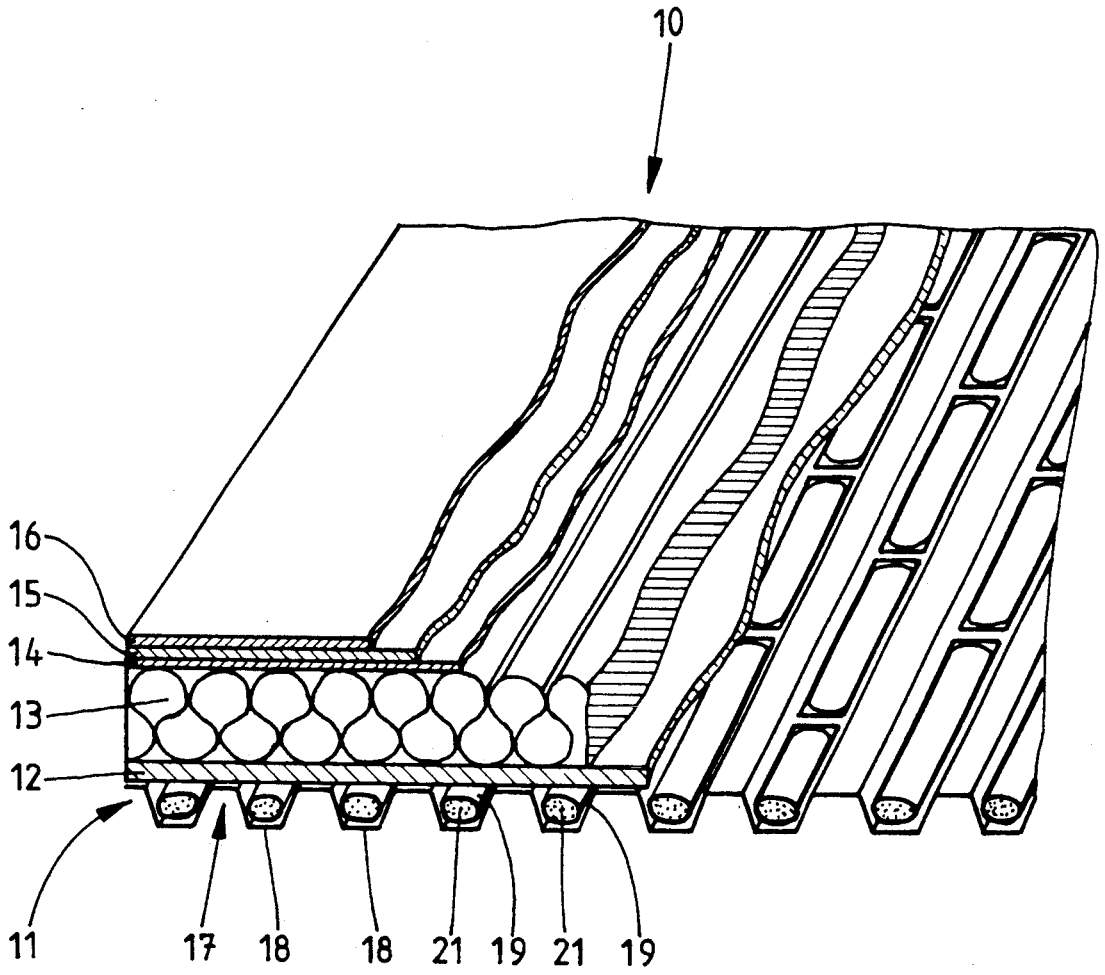

The invention relates to a roof covering or wall covering for a building or the like.

The steel profile-sheet (trapezoidally corrugated metal sheet) coverings mentioned here with insulating materials possibly arranged thereon find frequent use. At the same time, it has emerged that, in the event of fire, the heat is removed upwards from the trapezoidally corrugated metal sheet, and under these circumstances, there is a risk that flammable materials above the trapezoidally corrugated metal sheet will ignite. In addition the thermal energy acting on the trapezoidally corrugated metal sheet results in the gradual reduction of the load-carrying capacity of the trapezoidally corrugated metal sheet. In the event of fire, this results in an acute danger of collapse.

In order that the stability of the trapezoidally corrugated metal sheet remains intact in the event of fire, it is known to suspend a fire-protection layer composed of special panels beneath the trapezoidally corrugated metal sheet. This solution is, however, complicated and consequently expensive. In addition, the heat radiation is only screened from the trapezoidally corrugated metal sheet by the fire-protection layer but not eliminated, whereupon there is formed, in the burning room, a heat build up which may bring about an intensification of the fire. Finally, the special panels of the fire-protection layer may liberate gases which have disadvantageous consequences in numerous respects, for example they make the extinguishing operations more difficult.

In order to eliminate these disadvantages, it is known from German Offenlegungsschrift 3,615,116, to arrange containers or the like filled with water in the channels of the trapezoidally corrugated metal sheet. This has, however, the disadvantage that if the containers arranged in the channels burn through in the event of fire, water or the like escapes therefrom and can drain away without having any effect unless the supporting layer composed of individual (strip-like) trapezoidally corrugated metal sheets is constructed in a complicated manner so as to be watertight. But even in the case of watertightly constructed supporting layers, the water drains (laterally) out of the burnt-through point in the container, in particular if the covering is inclined. As a result of this, the water may get into regions which are situated outside the seat of the fire and in which it has virtually no effect.

Starting from this point, the invention is based on the object of further developing a roof covering or wall covering of the type mentioned in the introduction so that the fire-retarding substance fulfills its planned effect as ideally as possible in the event of fire.

This object is achieved by a roof covering or wall covering having the features of a supporting layer of corrugated metal steel, having open channels and a fire-retarding liquid located in the channels, and at least some of the fire-retarding liquid is thickened. Thickening the liquid arranged in the channels achieves the result that it is unable, or only insignificantly able, to flow away from the seat of the fire.

Expediently, thickened water is used as fire-retarding liquid, organic substances or a mixture of organic and inorganic substances preferably being used for thickening. As a result of this, the thickened liquid can be simply and cheaply produced.

According to a particularly advantageous embodiment of the roof covering or wall covering according to the invention, the thickened water is accommodated in encasing structures arranged in the channels. These reliably ensure that the water is only able to escape in the event of fire. If one or more encasing structures melts during a fire, the thickening assures that the water does not abruptly, and consequently without essentially achieving the intended effect, drain through the burn-through points. Expediently, the encasing structures are of gastight construction. Deterioration of the thickened water occurring in the course of time, in particular due to the thickening substance, are thereby reliably avoided.

Further embodiments of the invention relate to the structural embodiment of the encasing structures.

Figure 2:
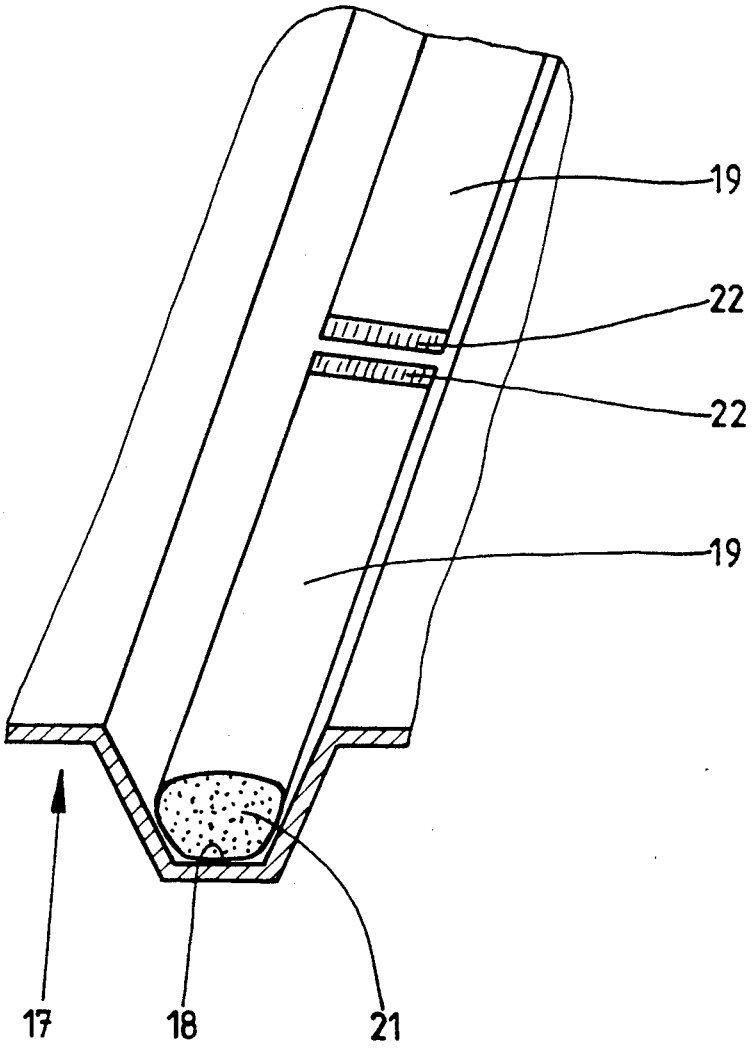
Figure 3:
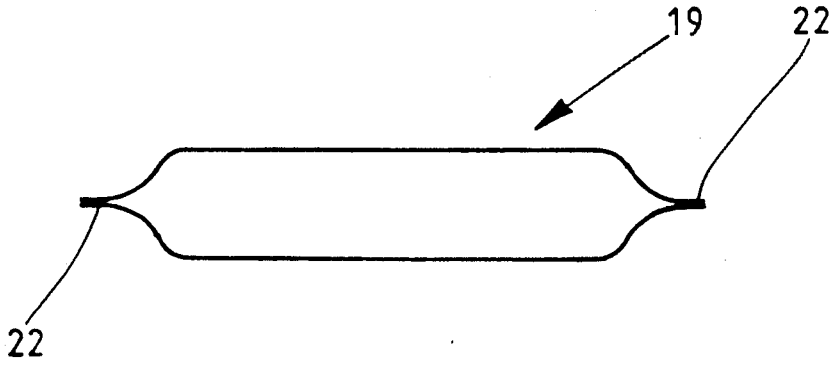
Figure 4:
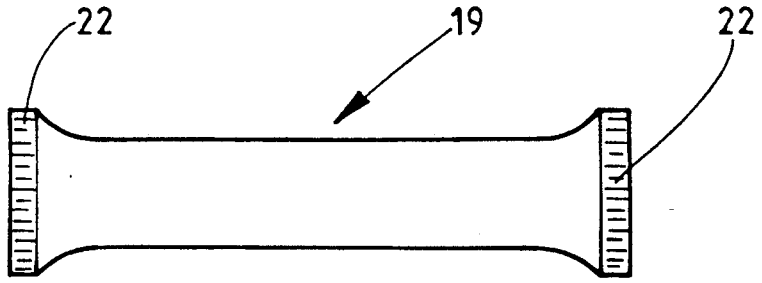
Figure 5:
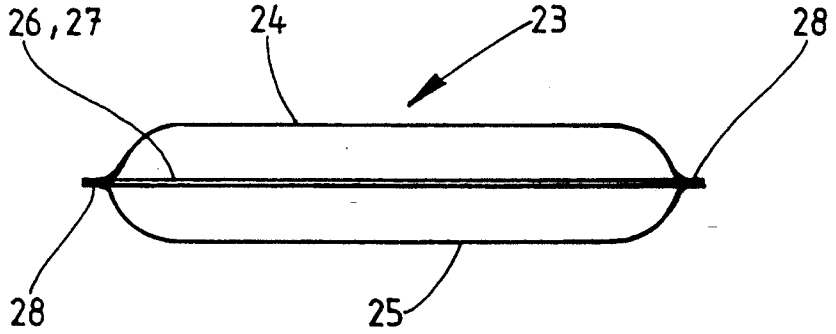
Figure 6:
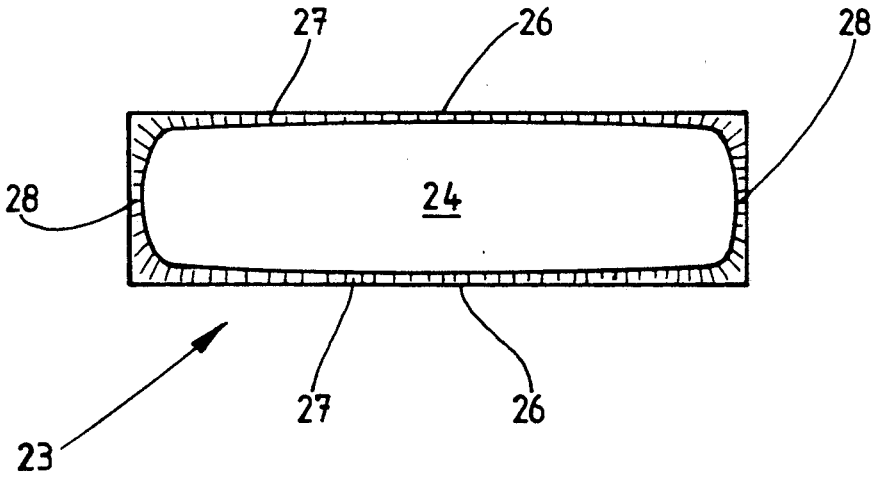
Figure 7:
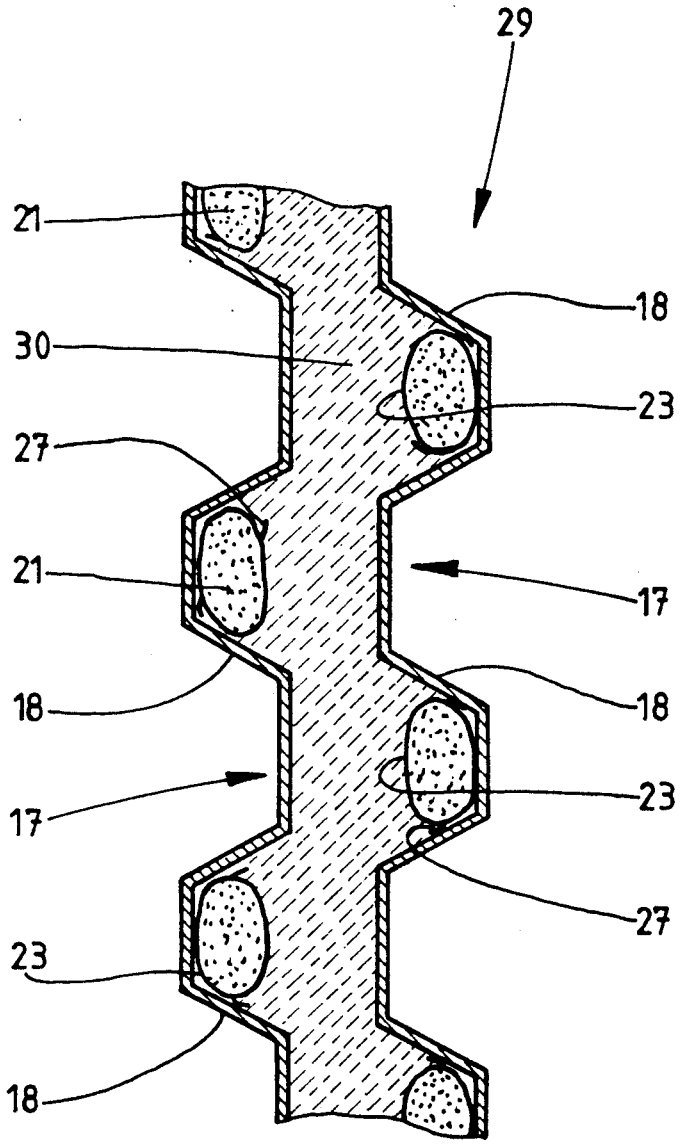

Preferred embodiments of the invention are described in more detail below with reference to the drawing. In this:

FIG. 1 shows a roof covering with a supporting layer constructed from trapezoidally corrugated metal sheet with further layers, in cut-away perspective representation, situated thereupon, FIG. 2 shows a part of the roof covering with flexible tubes arranged in a channel of the trapezoidally corrugated metal sheet according to FIG. 1 in enlarged cross-sectional representation, FIG. 3 shows the filled flexible tube in a side elevation, FIG. 4 shows the flexible tube of FIG. 3 in a plan view, FIG. 5 shows a filled cushion as an alternative to the flexible tube in a side elevation, FIG. 6 shows the cushion in a side elevation, and FIG. 7 shows a cross-section through a wall covering.

The embodiment shown in FIG. 1 relates to a roof covering 10 comprising a plurality of layers. The roof covering 10 is composed (from the bottom upwards) of a supporting layer 11, a vapor barrier 12, an insulating material layer 13, and also three sealing sheets 14, 15 and 16.

The supporting layer 11 is manufactured in the normal manner from steel sheet, namely constructed as trapezoidally corrugated metal sheet 17. The trapezoidally corrugated metal sheet 17 consequently has channels 18 which are arranged next to one another and which are open upwards, i.e. towards the vapor barrier 12. With an inclined arrangement of the roof covering 10, the channels 18 are oriented in the parallel extension direction to the roof ridge, that is to say, extend roughly horizontally.

In the case of the roof cover 10 shown in FIG. 1, there lie in each of the channels 18 elongated hollow bodies, namely flexible tubes 19, which approximately fill the cross section of the said channels. According to FIG. 2, the flexible tubes 19 are of shorter construction than the respective channel 18. Consequently, a multiplicity of flexible tubes 19 are arranged to lie behind one another in each channel 18. The length of the flexible tubes 19 is so chosen that they can be handled individually without difficulty. From this point of view, it has proved expedient to provide the flexible tubes 19 with a length of roughly 1 meter.

In the event of fire, it is important to protect the supporting layer 11 from overheating so that it does not lose its strength. This is achieved by the liquid enclosed in the flexible tubes 19. The heat developed during a fire causes the flexible tubes 19 situated in the region of the seat of the fire to burst or it melts holes in the flexible tubes 19, as a result of which the liquid arranged therein is liberated.

Water 21 treated in a particular manner, namely thickened, is used here as liquid in the flexible tubes 19. As a result of this, the water 21 acquires a relatively high viscosity which, when one or more flexible tube(s) bursts or melts through, prevents the water arranged therein from draining in a short time and consequently virtually unused in the event of fire. On the contrary, the thickened water 21 virtually remains in the flexible tubes 19, and to be specific, in particular also in the burst or burnt-through flexible tubes 19, in which it evaporates. The heat is removed from the supporting layer 11 by the large heat capacity of the water (and to be specific, also in the gelled condition) and also by the energy of evaporation required. Impairment of the supporting layer 19 in a static relationship consequently does not occur to an appreciable extent in the static aspect. In addition, the rising moisture creates an unfavorable climate for the occurrence of a fire in the roof finishing, in particular in the layers arranged above the supporting layer 11.

Organic substances are preferably used to thicken the water 21. As such cellulose ether or salts of an acrylic acid polymer or copolymer are, in particular, suitable. Even at the lowest concentration, that is to say, when small quantities are used, these result in a substantial thickening of the water 21. In particular, the use of these substances also ensures that the water 21 retains its thickened state virtually unchanged even after many years, and to be specific, without a formation of putrefaction or the like. In order reliably to exclude a risk of putrifaction, a preservative may further be added to the water in addition to the thickening agent. Suitable preservatives are: methyl p-hydroxybenzoate, isothiazolynones, ethyl p-hyroxybenzoate (commercial name Solbrol A supplied by Bayer AG), methyl p-hydroxybenzoate (commercial name Solbrol M supplied by Bayer AG), propyl p-hydroxybenzoate (commercial name Solbrol P supplied by Bayer AG), benzoic acid, sodium benzoate, sorbic acid or potassium sorbate. Because of their toxicological harmlessness, these substances are suitable in a particularly advantageous manner as preservatives.

If polyacrylic acid is used as starting substance for the thickening agent, the thickening of the water 21 occurs in that the latter is first mixed with 0.05 to 1% by weight, in particular 0.25% by weight, of acrylic acid without an appreciable thickening of the water already occurring under these circumstances. Only after adding an equivalent quantity of a neutralizing agent, for example a 10% sodium hydroxide solution, to the water 21 and the polyacrylic acid already dissolved in said water 21 does an abrupt thickening of the solution take place, as a result of which a highly viscous mixture is produced. Instead of sodium hydroxide solution, another hydroxide solution may also be used a neutralizing agent. Furthermore, it is alternatively possible to use low-molecular amines or ammonium hydroxide (sic) as neutralizing agents.

The preservative, which may be the abovementioned substances, is added to the water 21 before the neutralization of the polyacrylic acid, that is to say, some time before the occurrence of the thickening.

The example below is intended to clarify the relationship between the water 21 and the thickening agent and also the preservative in using polyacrylic acid as starting substance. Accordingly, the following mixing ratio is used:

94.9–99.74% by weight of water
0.05–1% by weight of polyacrylic acid (e.g. Carbopol supplied by the B. F. Goodrich Company)
0.01–0.1% by weight of methyl p-hydroxybenzoate (alternatively one of the alternative preservative substances specified above within the specified quantity range)
0.2–4% by weight of a 10% solution of sodium hydroxide In order to avoid the neutralization of the thickening agent in preparing the thickened water 21, it is also conceivable to add the sodium salt of a copolymer (Hostacerin supplied by Hoechst Company) directly to the water to be thickened. The use of a neutralizing agent, for example a 10% sodium hydroxide solution, is then no longer necessary for preparing the thickened water 21.

The thickening of the water with the aid of cellulose ether can be carried out with 1–5% by weight, in particular 3% by weight of methylcellulose. The following mixing ratio then results:

94.9–98.98% by weight of water
1–5% by weight of methylcellulose
0.02–0.1% by weight of methyl p-hydroxybenzoate (alternatively, one of the preservatives mentioned above can be used in the same weight range).

The two abovementioned mixtures may alternatively further contain additives, namely texotopic agents, for example salicylic acid, but also in addition to the additives or as an alternative thereto, inorganic fillers.

The flexible tubes 19 serving to receive the thickened water are produced from a thermoplastic laminate. Preferably it is composed of two layers, namely an (inner) ethylene-vinyl acetate copolymer layer and an (outer) polythylene layer. Both layers are joined to each other during the manufacture. A particularly good weldability of the flexible tube 19 is ensured by this construction of the laminate, in particular the inwardly situated arrangement of the ethylene-vinyl acetate copolymer layer, since, to form the fin welds 22, the (inner) ethylene-vinyl acetate copolymer layers which are directed towards each other and which have better welding properties, in particular a lower melting point, compared with the polyethylene of the outer layer, can be welded directed to each other. On the other hand, the polyethylene outer layer ensures a gas tightness of the flexible tubes 19 which is reliable even over a prolonged period, as a result of which a volatilization or decomposition of the thickened water 21 arranged therein is reliably avoided. Preferably, the outer polyethylene layers of the laminate are thicker than the (inner) ethylene-vinyl acetate copolymer layers.

The flexible tubes 19 are formed in that a flexible tube section open at opposite end faces is cut off in a suitable length from an endless, preferably cylindrical flexible tube extrudate, having a wall thickness of around 0.4 mm, and first closed by welding at one end face, preferably by a hot-seal weld, as a result of which a fin weld 22 is produced at one side. The already thickened water 21 is then poured in through the then still open end face of the flexible tube prepared to this extent. Thereafter, the second end face left open to pour in the thickened water is sealed, likewise by a hot-seal weld, so that a fin weld 22 is also produced here. On the basis of the mode of production described above, a flexible tube 19 according to FIGS. 3 and 4 is produced. This seals the thickened water contained therein hermetically in an airtight manner so that the latter is effectively protected against external influences even over a prolonged period of time, and to be specific, against an evaporation or decomposition.

A three-layer laminate of an (inner) polyethylene layer, an intermediately situated aluminum layer and an (outer) polyester layer may also be used for the flexible tube 19. In this case, the aluminum layer may be formed by single-sided inner vapor-coating either of the polyethylene or the polyester layer. The welding of the flexible tube 19 to form the fin welds 22 is carried out here at the (inner) polyethylene layers which are directed towards each other and which have a lower melting point compared with the (outer) polyester layers, so that a satisfactory welding is possible without appreciable deterioration of the outer, higher-melting polymer layer.

FIGS. 5 and 6 show an alternative to the flexible tube 19, namely an encasing body for the thickened water 21 formed as cushion 23. Said cushion 23 is formed from two elongated blanks 24 and 25 arranged as a double layer. These are first welded at the oppositely situated longitudinal edges 26, as a result of which two parallel longitudinal welds 27 are produced in this case. Then one of the two open end faces is sealed by a further weld, namely again a fin weld 28. The thickened water 21 is then poured into the cushion 23 through the then still open second end face and the former is thereupon completely sealed by forming the second fin weld 28.

Either a two-layer thermoplastic laminate of the materials described in connection with the flexible tube 19 or a three-layer laminate with an aluminum intermediate layer is suitable as material for the cushion 23.

FIG. 7 shows an upright wall covering 29. In this, a (central) foam material layer 30 and the cushions 23 shown in FIGS. 5 and 6 are arranged between two supporting layers 11, namely trapezoidally corrugated metal sheets 17 with horizontally extending channels 18. The wall covering 29 consequently has a sandwich-type construction.

Alternatively, it is possible to accommodate flexible tubes 19 in the channels 18 of the trapezoidally corrugated metal sheets 17 instead of the cushions 23.

The roof covering 10 shown in FIGS. 1 and 2 and the wall covering 29 shown in FIG. 7 each have flexible tubes 19 or cushions 23 arranged in one layer behind one another in the channels 18 of the trapezoidally corrugated sheets 17. In contrast to this, it is alternatively conceivable to arrange thinner flexible tubes 19 or cushions 23 with smaller cross-sectional dimensions also situated next to one another or above one another in a multiplicity of layers in the channels 18.

According to a preferred further development of the invention, flexible tubes 19 or cushions 23 containing unthickened water and thickened water 21 are arranged alternatingly in the channels 18. The cushions 23 or flexible tubes 19 containing thickened water 21 then form barriers which seal the channels 18 in a liquid-tight manner against a drainage of the unthickened water after the cushions 23 or flexible tubes 19 receiving the latter have burst or burnt through. It is also conceivable to arrange a multiplicity of cushions 23 or flexible tubes 19 containing unthickened water between every two cushions 23 or flexible tubes 19 containing thickened water 21.

I claim:

1. A roof covering or wall covering for a building comprising a supporting layer (11), having open channels, made of corrugated metal sheet (17), and encasing structures arranged in said channels (18), said encasing structures being formed as tubes or cushions sealed in a gas-tight manner and formed from a plastic laminate having at least two layers, and said encasing structures filled with a fire-retarding substance, said fire-retarding substance being a thickened liquid.

2. Roof covering or wall covering according to claim 1, characterized in that the fire-retarding liquid is water (21) thickened by a thickening agent which is an organic substance.

3. Roof covering or wall covering according to claim 2, characterized in that the thickening agent is cellulose ether, in particular methyl cellulose with a concentration of 1 to 5% by weight, preferably 3% by weight.

4. Roof covering or wall covering according to claim 2, characterized in that the thickening agent is a neutralized acrylic acid polymer or copolymer, in particular polyacrylic acid with a concentration of 0.05 to 1% by weight, preferably 0.25% by weight.

5. Roof covering or wall covering according to claim claims 3 or 4, characterized in that a preservative, in particular isothiazolynones, methyl p-hydroxybenzoate, ethyl p-hydroxybenzoate, methyl p-hydroxybenzoate, propyl p-hydroxybenzoate, benzoic acid, sodium benzoate, sorbic acid or potassium sorbate is added to the thickening agent.

6. Roof covering or wall covering according to claim 1, wherein said tubes (19) or cushions (23) are formed from a polyethylene modified with ethylene-vinyl acetate copolymer.

7. Roof covering or wall covering according to claim 1, characterized in that the flexible tube (19) or cushions (23) are formed from a three-layer polyester aluminum/polystyrene laminate.

8. Roof covering or wall covering according to claim 1, characterized in that the flexible tubes (19) are closed by welding at their oppositely situated end faces, preferably by a fin weld (22) in each case.

9. Roof covering or wall covering according to claim 1, characterized in that the cushions (23) are formed from blanks (24, 25) welded all round.

* * * * *